US009328453B2

(12) United States Patent
Al-Zahrani

(10) Patent No.: US 9,328,453 B2
(45) Date of Patent: May 3, 2016

(54) AUTOMATIC IRONING SYSTEMS AND METHODS

(71) Applicant: UMM AL-QURA UNIVERSITY, Makkah (SA)

(72) Inventor: Fahad Mohammed Al-Zahrani, Makkah (SA)

(73) Assignee: Umm Al-Qura University, Makkah (SA)

( * ) Notice: Subject to any disclaimer, the term of this patent is extended or adjusted under 35 U.S.C. 154(b) by 60 days.

(21) Appl. No.: 14/364,215

(22) PCT Filed: Jun. 3, 2014

(86) PCT No.: PCT/IB2014/000937
§ 371 (c)(1),
(2) Date: Jun. 10, 2014

(87) PCT Pub. No.: WO2015/185953
PCT Pub. Date: Dec. 10, 2015

(65) Prior Publication Data

US 2015/0345073 A1 Dec. 3, 2015

(51) Int. Cl.
*D06F 69/00* (2006.01)
*D06F 87/00* (2006.01)
*D06F 67/00* (2006.01)

(52) U.S. Cl.
CPC ..... *D06F 69/00* (2013.01); *D06F 67/005* (2013.01); *D06F 87/00* (2013.01)

(58) Field of Classification Search
CPC ..... D06F 73/02; D06F 87/00; D06F 67/00; D06F 67/005; D06F 58/10; D06F 58/12; D06F 58/14; D06C 7/08; A47K 10/48; A47F 5/025; A47B 61/00; A47B 61/003
See application file for complete search history.

(56) References Cited

U.S. PATENT DOCUMENTS 3,026,180 A * 3/1962 Cubeddu ..... C01B 15/023 423/589
3,664,159 A * 5/1972 Mazza ..... D06F 17/04 68/20

(Continued)

FOREIGN PATENT DOCUMENTS

CN 201665786 12/2010
CN 201678877 12/2010

(Continued)

OTHER PUBLICATIONS

Written Opinion and International Search Report issued Jan. 29, 2015 in PCT/IB2014/000937.

*Primary Examiner* — Ismael Izaguirre
(74) *Attorney, Agent, or Firm* — Oblon, McClelland, Maier & Neustadt, L.L.P

(57) ABSTRACT

An automatic ironing system and method comprise a volumetric enclosure configured to receive an article to be steamed, and a base configured to support, power, and provide steamed water to the volumetric enclosure. The system also comprises a rotary engine configured to rotate the article when activated, and at least one steam nozzle configured to direct steam towards the article. The system also comprises a receptacle configured to receive condensed steam from the volumetric enclosure and to recirculate the condensed steam for re-use, and a controller configured to monitor one or more variables of the automatic ironing system and adjust parameters according to instructions.

18 Claims, 10 Drawing Sheets

(56) References Cited

U.S. PATENT DOCUMENTS

| | | | | | |
|---|---|---|---|---|---|
| 3,696,523 | A * | 10/1972 | Beeley | D06F 73/02 | 211/1.52 |
| 3,752,373 | A * | 8/1973 | Smith | D06F 73/02 | 219/401 |
| 4,980,981 | A | 1/1991 | Naidoo | | |
| 5,345,060 | A | 9/1994 | Hazan et al. | | |
| 5,970,637 | A * | 10/1999 | Mohan | D06F 71/20 | 223/70 |
| 6,925,737 | B2 * | 8/2005 | Bolduan | D06F 17/04 | 38/1 A |
| 2004/0206131 | A1 * | 10/2004 | Kleker | D06F 17/04 | 68/5 C |
| 2005/0115120 | A1 | 6/2005 | Cevik | | |

FOREIGN PATENT DOCUMENTS

| | | |
|---|---|---|
| CN | 202865653 | 4/2013 |
| EP | 1 995 372 B1 | 5/2010 |
| KR | 10-0547653 B1 | 2/2006 |
| KR | 10 2010 0067780 | 6/2010 |

* cited by examiner

AUTOMATIC IRONING SYSTEMS AND METHODS

BACKGROUND OF THE INVENTION

Manually ironing articles of clothing and linens has been a labor-intensive activity for several decades. The ironing device has evolved over time with the addition of more features and more light-weight materials. However, manually ironing articles is still time consuming.

Automatic ironing systems have attempted to decrease the requirement for human intervention which has resulted in a savings of time, as well as improved safety from manual iron-induced burns and decreased heat to the user and the immediate environment.

One example of an automatic ironing system comprises two large presses that are fed with heat and steam. The article to be ironed is placed on a lower press, while the upper press is closed against the top side of the article. Since the two presses have a large surface area, the process is much faster than using a manual iron. However, this automatic ironing system is limited to relatively flat articles, such as linens.

Another example of an automatic ironing system comprises an upright enclosure in which the article is suspended and exposed to steam. This system provides ironing to non-flat articles, such as a dress or a shirt. However, the enclosure needs to be large enough to fit the largest desired article. As a result, a large enclosure would not be energy or time efficient when ironing a small article.

In addition to the disadvantages of the two systems described above, both systems are large, heavy, and costly. For many situations, the advantages of these automatic ironing systems do not outweigh the disadvantages.

SUMMARY OF THE INVENTION

In an embodiment, an automatic ironing system comprises a volumetric enclosure configured to receive an article to be steamed, and a base configured to support, power, and provide steamed water to the volumetric enclosure. The system also comprises a rotary engine configured to rotate the article when activated, and at least one steam nozzle configured to direct steam towards the article. The system also comprises a receptacle configured to receive condensed steam from the volumetric enclosure and to recirculate the condensed steam for re-use, and a controller configured to monitor one or more variables of the automatic ironing system and adjust parameters according to instructions.

In an embodiment, an automated method of ironing an article comprises dispensing steam within a volumetric enclosure via one or more flexible steam nozzles, and rotating an article suspended from a rotary engine of the volumetric enclosure. The method also comprises capturing condensed steam in a reservoir for recirculation within the volumetric enclosure, and controlling one or more parameters according to instructions via a controller connected to the volumetric enclosure.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Like reference numerals of the drawings designate identical or corresponding parts throughout the several views.

DETAILED DESCRIPTION

Figure 1:
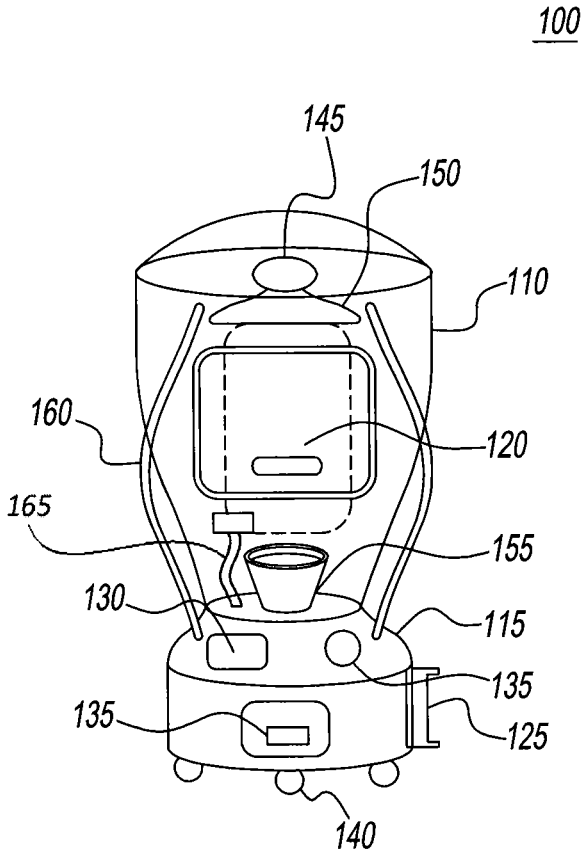
FIG. 1 is an illustration of an automatic ironing system, according to one example.

FIG. 1 is an illustration of an automatic ironing system, according to one example. The automatic ironing system 100 comprises a volumetric enclosure 110, which is supported by a base 115. The volumetric enclosure 110 is configured to receive an article 120, which will be steamed or ironed to remove wrinkles. The article 120 includes, but is not limited to articles of clothing, linens such as bed, bath, or kitchen linens, and any natural or man-made fabric item. The base 115 is configured to support, power, and provide steamed water to the volumetric enclosure 110. The base 115 also comprises an external power connection 125, and an input panel 130 for inputting instructions and operating parameters. The input panel 130 is connected to a processing unit, which controls operation of the automatic ironing system according to the input instructions and operating parameters. The base 115 also comprises one or more indicators 135, which include but are not limited to light indicators, gauges, and alarms. The base 115 further comprises wheels or rollers 140 on the bottom surface to provide easier manipulation of the automatic ironing system. The rollers 140 can be locked to maintain the system's position.

The volumetric enclosure 110 is illustrated in FIG. 1 as a cylindrical enclosure. However, any three-dimensional shaped enclosure is contemplated by selected embodiments such as a rectangular or cube shaped enclosure in which an article can be placed for the purpose of being ironed to remove wrinkles. The volumetric enclosure 110 is made of an unbreakable and anti-heat material to maximize safety of the operator and to minimize heat loss to the environment. An embodiment of the volumetric enclosure 110 material includes fibre glass or plexiglass; however, other materials that are unbreakable and anti-heat materials are contemplated by selected embodiments. It may be desirable to have the volumetric enclosure 110 material be transparent or semi-transparent. However, non-transparent materials can also be used.

A door is present on the front surface or other surface of the volumetric enclosure 110 for inserting and removing the article 120 to be ironed. The door can be hinged and open at either side or at the top of the volumetric enclosure 110. Seals are present around the door and around the opening of the volumetric enclosure 110 to prevent steam from escaping into the environment. A safety lock is also present on the door to prevent opening the volumetric enclosure 110 during an operating process.

An article to be ironed can come in many shapes and sizes. For example, a napkin would require a much smaller volumetric enclosure 110 than a bed sheet. Therefore, it would be advantageous to adjust the volume of the volumetric enclosure 110 accordingly. The volumetric enclosure 110 can be expanded in either the vertical or the horizontal direction, or both directions to accommodate the size of the article to be ironed. The expansion and compaction of the volumetric enclosure 110 could be implemented either manually or via processor control. The base 115 would be of a size and structure to support the largest expansion available to the volumetric enclosure 110. The seams between an original panel and an expansion panel of the volumetric enclosure 110 would have tightly fitting seals to prevent steam from escaping into the environment. When the automatic ironing system is not in use, the system can be collapsed to its smallest size, which requires minimal storage space and optimizes ease of movement.

Figure 2A:
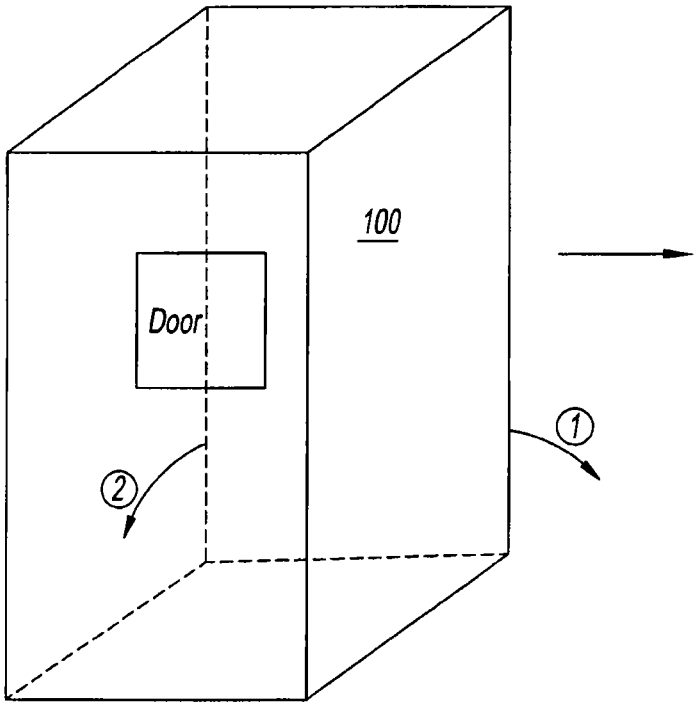
FIGS. 2A-2F are illustrations of an expanded automatic ironing system, according to one example.
Figure 2B:
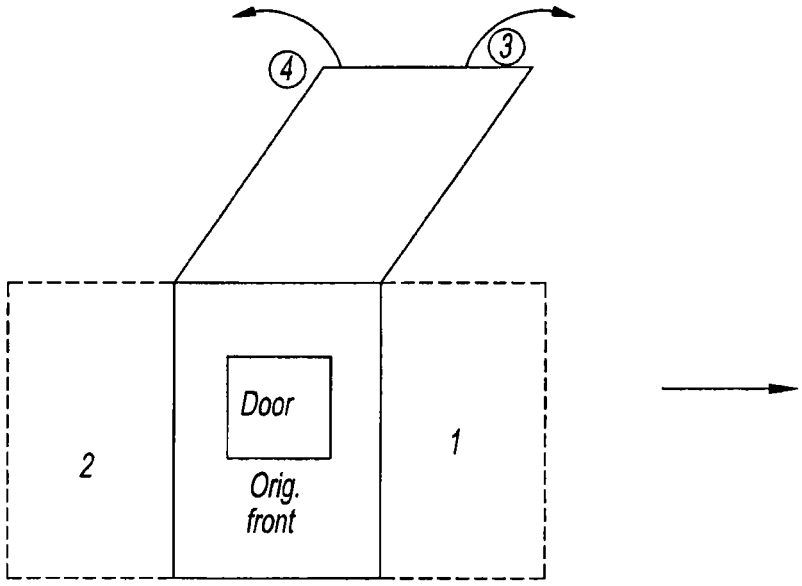

FIGS. 2A-2F illustrate an embodiment in which the width of a volumetric enclosure 110 is expanded. FIG. 2A illustrates an original collapsed volumetric enclosure 110. In an expanded state, the right side panel will be extended forward, illustrated by a circled-1, such that it will become flush with the original front panel of the volumetric enclosure 110. Likewise, the left side panel will be extended forward, illustrated by a circled-2, such that it will become flush with the original front panel of the volumetric enclosure 110. FIG. 2B illustrates the result of extending the right side panel and the left side panel.

Figure 2C:
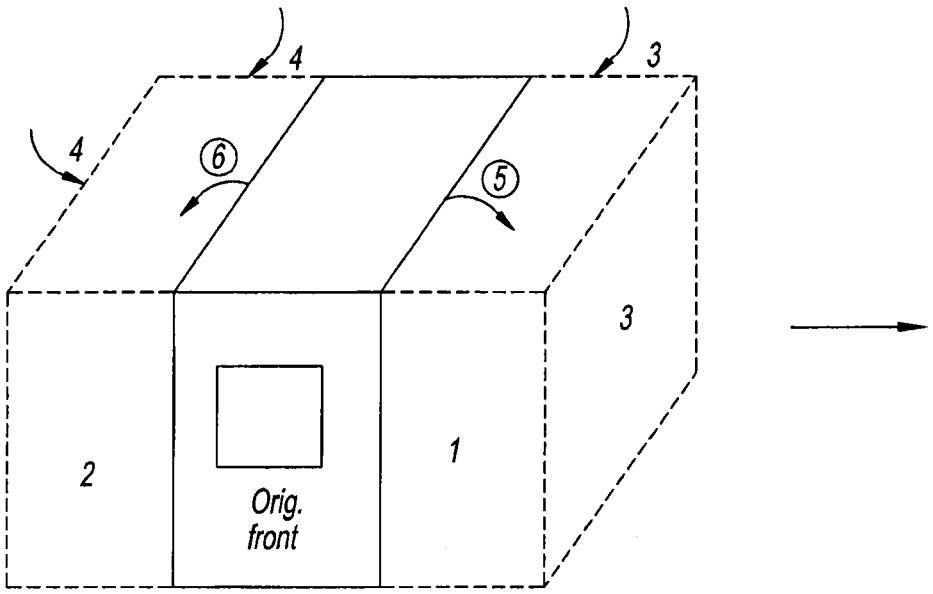

FIG. 2B also illustrates a right-handed double panel will be extended from the original back panel to form a new right back panel extension and a new right side panel extension, illustrated by a circled-3. Likewise, a left-handed double panel will be extended from the original back panel to form a new left back panel extension and a new left side panel extension, illustrated by a circled-4. FIG. 2C illustrates the result of extending the double back right-handed panel and the double back left-landed panel to form the new back panel extensions and the new side panel extensions.

Figure 2D:
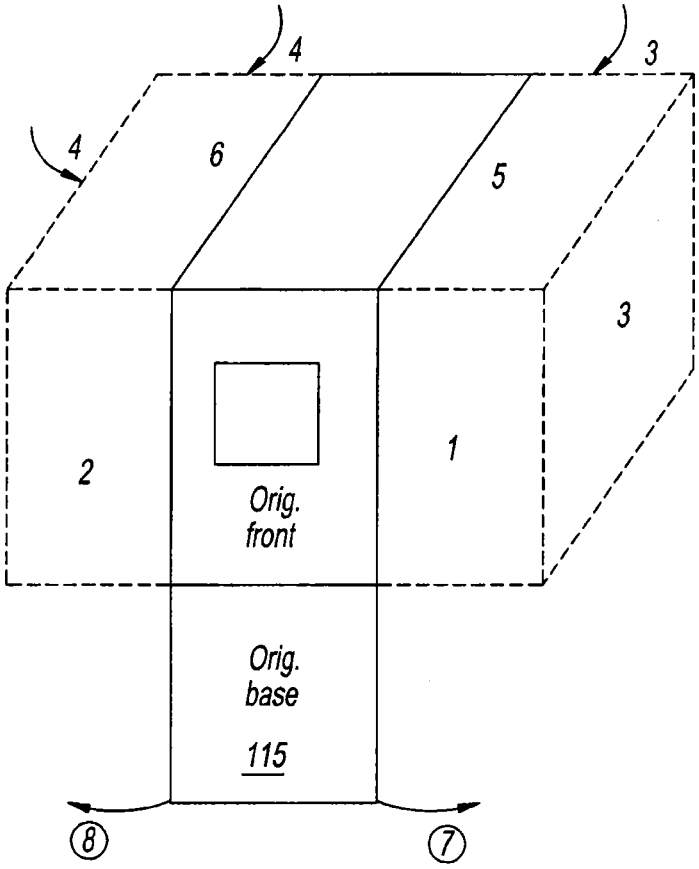

FIG. 2C also illustrates a top right panel will be extended from the original top panel to form a new right top panel extension, illustrated by a circled-5. Likewise, a top left panel will be extended from the original top panel to form a new left top panel extension, illustrated by a circled-6. FIG. 2D illustrates the result of extending the right and left top panels to form the new top panel extensions.

Figure 2E:
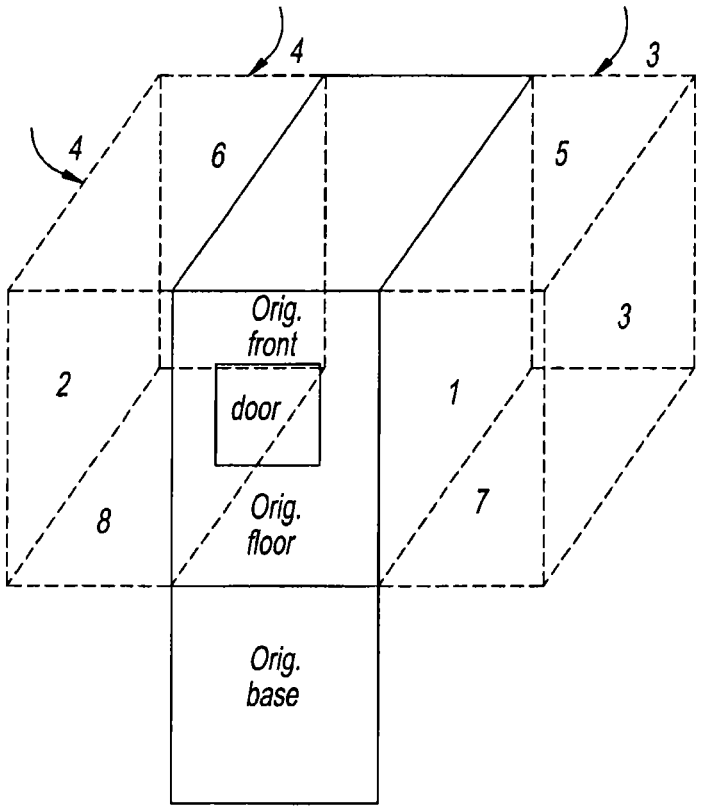

FIG. 2D also illustrates a floor panel along the right side of the base 115, which is extended upwards to form a new right floor panel extension, as illustrated by a circled-7. Likewise, a floor panel along the left side of the base 115 is extended upwards to form a new left floor panel extension, as illustrated by a circled-8. FIG. 2E illustrates the result of extending the right and left floor panels to form new floor panel extensions.

Figure 2F:
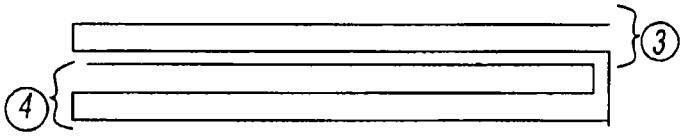

The extension panels are constructed such that each panel is connected to an original panel, but folds flat against the original panel at 180 degrees. FIG. 2F illustrates a top view of the extension panels butted flat against the original back wall panel. Two extension panels are butted against and connected to the original back panel from a left side. These two extension panels unfold to form the back left extension panel, and wrap around 90 degrees to also form the left side extension panel. This was illustrated in FIG. 2B as the circled-4 step. Two other extension panels are connected to the original back panel from a right side and are butted against the left extension panels. These two extension panels unfold to form the back right extension panel, and wrap around 90 degrees to also form the right side extension panel. This was illustrated in FIG. 2B as the circled-3 step.

In an embodiment, the free edges of the extension panels and the original panels are formed with a rubber or vinyl molding, such that escape of the steamed vapor is minimized when connected. The edges of the panels are connected and sealed with 90 degree clamps. For example, the right and left front panels would clamp connect along the sides with the side edges of the right and left back panel extensions, respectively. The three edges of the right and left top panel extensions are connected with 90 degree clamps to the top edges of the back and side extension panels and the right and left front panels. The three edges of the right and left floor panel extensions are connected with 90 degree clamps to the bottom edges of the back and side extension panels and the right and left front panels. Other types of clamps and molding are contemplated by embodiments described herein, to provide a tight-forming seal between panels and to tightly connect the panels mechanically.

The embodiment described above provides a volumetric enclosure that is three times the original enclosure volume. Another embodiment of two times the original enclosure volume can be implemented, wherein only the right side of the volumetric enclosure 110 is expanded. In this example, the original right side panel is extended forward, illustrated by the circled-1. The right-handed double panel is extended from the original back panel to form the new right back and right side panel extensions, illustrated by the circled-3. The top right panel is extended from the original top panel to form the new right top panel extension, illustrated by the circled-5. The floor panel along the right side of the base 115 is extended upwards to form the new right floor panel, illustrated by the circled-7. In the embodiment for a right expansion only of the volumetric enclosure 110, a stabilizing unit is placed under the right extended volume, since the center of gravity has shifted to the right away from the center of the base 115.

With reference back to FIG. 1, a rotary engine 145 is illustrated, along with a hanger 150 attached to the lower side of the rotary engine 145 inside the volumetric enclosure 110. The hanger 150 suspends the article 120 to be ironed. An embodiment of the invention comprises multiple types of hangers 150 of varying width to accommodate different sizes and shapes of articles 120. Another embodiment includes hangers 150 comprising hooks or clips to adequately suspend various types, sizes, and shapes of articles 120. The rotary engine 145 can be adjusted to rotate at multiple speeds, according to input instructions. Another embodiment comprises a rotary engine 145 that rotates clockwise for a set period of time or number of rotations, and switches to a counter clockwise rotation for another set period of time or number of rotations. An ironing cycle would comprise switching back and forth between clockwise and counter clockwise rotations to maximize infiltration of the steam to all areas of the article 120. In the embodiments described above for expanding the volumetric enclosure 110 with reference to FIGS. 2A-2F, the rotary function may not be activated, since the article 120 might extend beyond the front and back borders of the volumetric enclosure 110 upon rotation.

A bottom steam cannon 155 is located on top of the base 115, within the lower level of the volumetric enclosure 110. Water is held within the base 115 and heated to a set temperature or vapor point. The resultant steam is pumped into the volumetric enclosure 110, via the bottom steam cannon 155. The temperature, pressure, humidity, and rate of steam emission, as well as other variables can be controlled according to input instructions. These variables are also adjusted according to the selected volume of the volumetric enclosure 120, as discussed with reference to FIG. 2.

FIG. 1 also illustrates at least one loft steam nozzle or steam cannon 160 in the volumetric enclosure 110. The loft steam cannon 160 provides steam to an upper area of the volumetric enclosure 110, and is made of a pliable and flexible material to allow for movement and varied positioning of the exhaust opening of the loft steam cannon 160. Multiple loft steam cannons 160 could be of adjustable height to provide maximum positioning with respect to the article 120 being steamed. The loft steam cannons 160 are made of a material that can be flexed and extended, and still maintain their resting positions. The loft steam cannons 160 and the bottom steam cannon 155 are made of a material that can withstand a high humidity environment, such as stainless steel for the bottom steam cannon 155 and fibre glass sections for the loft steam cannons 160. However, other materials that can withstand a high humidity environment are contemplated by selected embodiments.

The flexible and adjustable loft steam cannons 160 can also be positioned in areas of heavy wrinkling of the article 120, so as to maximize the effectiveness and efficiency of the ironing. Another embodiment comprises attaching and suspending one or more weights to a bottom edge of the article 120 to be ironed. This would increase the effectiveness and efficiency of the ironing process by stretching the fabric of the article 120 while it is being steamed. The weights can be attached using one or more clips. The clips are of various size, spring strength, and surface content to accommodate the different types of fabric of the article 120. The weights comprise actual weighted masses integrated with a clip. The mass of the selected weight would be determined by the fabric, i.e. a stiff fabric or a delicate fabric, and the amount of wrinkling, wherein a heavily wrinkled fabric would require a larger massed weight.

An alternative embodiment in lieu of actual weights includes one or more weight extensions 165 originating from the base or one or more sides of the automatic ironing machine, integrated at the loose end with a clip. Various types of clips, as discussed above would clip onto the bottom edge of the article 120 to be ironed. Each weight extension 165 would extend as far as needed during use and retract into the floor of the automatic ironing machine when finished. A spring-loaded reel is an example in which to execute this alternative embodiment. The amount of weight to apply to a weight extension 165 would be inputted into the input panel 130, wherein the input would include options, such as the actual weight, a weight range, or a general description of light, medium, or heavy weight. This provides the advantage of the same weight extension 165 configured to implement a full range of desired weights.

The input panel 130 is used to input various parameters and to make other selections of pre-programmed cycles, or to select an automated cycle. Specific parameters can be input by the user in a first embodiment of the invention. Input parameters include, but are not limited to the specific item to be ironed, such as a lady's blouse or men's trousers, the fabric of the article 120, the degree of wrinkles, such as lightly wrinkled or heavily wrinkled, the amount of steam to dispense, a rate of dispensing the steam, and the length of the ironing cycle. A second embodiment includes pre-programmed cycles, which are available for selection of more commonly ironed items. The parameters in this second embodiment have already been established as part of the particular pre-programmed cycle. These parameters are viewable and can be altered, if desired or additional parameters can be added to the established parameters of the pre-programmed cycle.

A totally automated cycle is also available, in which various sensors determine the parameters to use for the ironing cycle. A first sensor or group of sensors determines the type of article 120 to be ironed, using one or more scanning devices 528, such as cameras. One embodiment comprises a group of fixed cameras, installed at different locations to capture different views of the article 120. Another embodiment includes a fewer number of cameras that rotate vertically and horizontally to capture multiple views of the article 120. The captured images are registered and compared to a database of different types of articles 120 to determine the type of article 120 to be ironed. The comparison may be performed by picture matching as would be understood by one of ordinary skill in the art. The database of different types of articles 120 is stored in a processing unit connected to the input panel 130 or can be accessed externally via a network. The scanning devices 528 can also capture other features of the article 120, such as the size, color, and the degree of wrinkling, and adjust the parameters accordingly.

Another sensor or group of sensors, such as a sensor 530, determines the fabric of the article 120 to be ironed. The type of fabric may be determined, in part by the scanning devices 528 described above. The sensor 530 is designed to project and receive a signal to and from the surface of the article 120. The signal is registered and compared to a database of received signals, which are associated with a particular type of fabric.

Other sensors are included in the automatic ironing system, which include but are not limited to sensors that receive and measure the temperature of the reservoir water and steam, pressure of the steam pumped into the volumetric enclosure 110, humidity within the volumetric enclosure 110, level of the reservoir water, and pressure within the steam cannons. A high pressure within the steam cannons may indicate a need to purge or clean the system. One or more indicators are also included within the automatic ironing system, such as gauges for the measured temperatures, pressures, and humidity levels. Indicators and alarms are also included for any conditions that might require immediate attention or intervention from a user, such as a temperature or pressure level that is well above an established or safe temperature or pressure, or an alarm for a low water level. A ringer or buzzer could also sound when the ironing cycle is completed.

Parameters received from all of the sensors of the automatic ironing system, along with any user-input parameters are used by the processing unit to determine the ironing cycle to implement. As a result, a wide range of types, sizes, and fabrics of an article 120 can be ironed using the automatic ironing system and processes described herein.

An embodiment of the invention includes a mechanism for applying starch to the article 120 at the conclusion of the ironing cycle. The starch is applied through one or more nozzles within the volumetric enclosure 110. The starch nozzles are similar to the steam nozzles 160, described above, wherein the length of the starch nozzle is adjustable and the opening of the starch nozzle can be positioned where desired with respect to the article 120. Variables for a light, medium, and heavy starch are available as input parameters.

Figure 3:
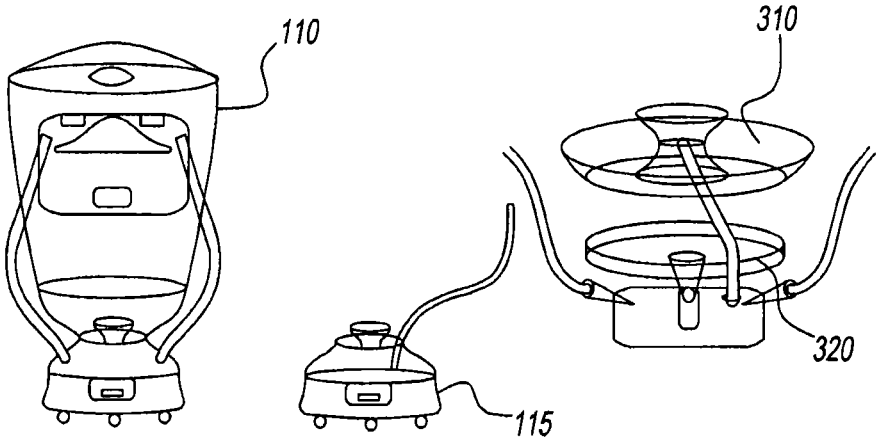
FIG. 3 is an illustration of a recirculatory system of an automatic ironing system, according to one example.

FIG. 3 illustrates a more detailed view of the automatic ironing system of FIG. 1, including a water recirculatory system. A receptacle 310 is illustrated, which collects the condensed steam within the volumetric enclosure 110. The condensed steam is directed to and held in a basin 320, where it is heated, steamed, and reused within the volumetric enclosure 110. This recirculation and re-use of the condensed steam provides a more energy efficient system, since the condensed steam is still warm and requires less heating. It also promotes water conservation by re-using the water instead of disposing the used water and inputting entirely new water.

A water recirculatory system, such as that used by selected embodiments, will accumulate mineral deposits within the loft steam cannons 160 and the bottom steam cannon 155, as well as the receptacle 310 and the basin 320. Accordingly, selected embodiments comprise a cleansing or purging system, in which chemicals and/or high pressure steam is introduced into the circulatory system of the automatic ironing system for a set period of time. A vinegar solution and a muriatic acid solution are examples that could be used to remove water mineral deposits. However, embodiments of the invention contemplate other cleansing chemicals and processes. One or more cycles of clean steam are circulated throughout the circulatory system to remove any residuals remaining from the purging cycle. A waste receptacle collects the mineral-laden chemical solution or steam, which is properly disposed outside of the system. The condensed steam collected in the basin 320 could also be disposed and new water added, aside from a cleansing or purging process.

Another embodiment comprises attaching a water filtering system to the circulatory system of the automatic ironing system, which filters minerals from the incoming water. This is used in lieu of or in addition to the purging system described above.

Figure 4:
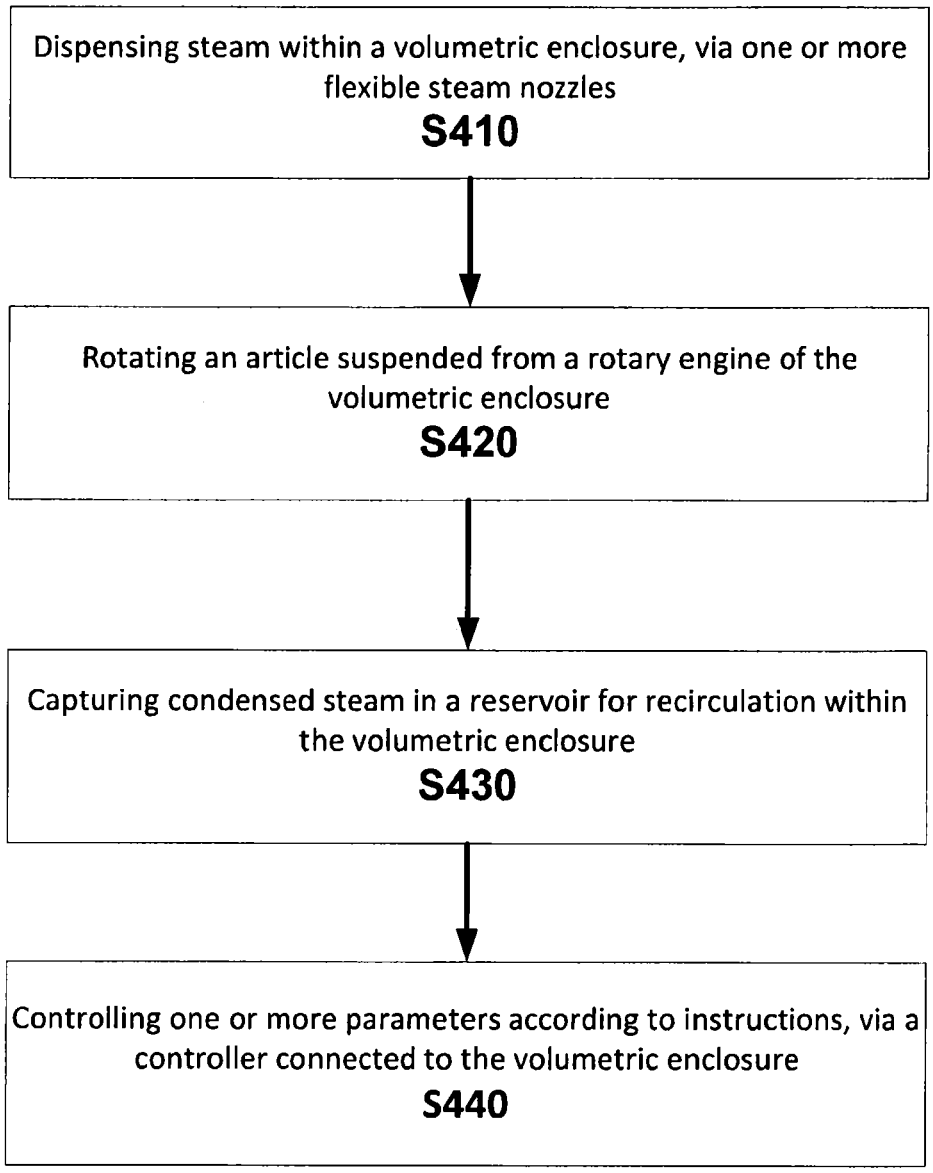
FIG. 4 is a flow chart of an automated method of ironing an article, according to one example.

FIG. 4 is a flow chart for an automated method of ironing an article. The article includes any article of clothing, linens such as bed, bath, or kitchen linens, and any natural or man-made fabric item. The method includes dispensing steam within a volumetric enclosure, using one or more flexible steam nozzles in step 410, such as the loft cannons 160 described above. The article is suspended from a rotary engine, such as the rotary engine 145 described above, and the article is rotated within the volumetric enclosure in step 420. The condensed steam within the volumetric enclosure is captured for recirculation in step 430, using the receptacle 310 and basin 320 as described above, as an example. One or more parameters are controlled according to input instructions using a controller connected to the volumetric enclosure in step 440.

Figure 5:
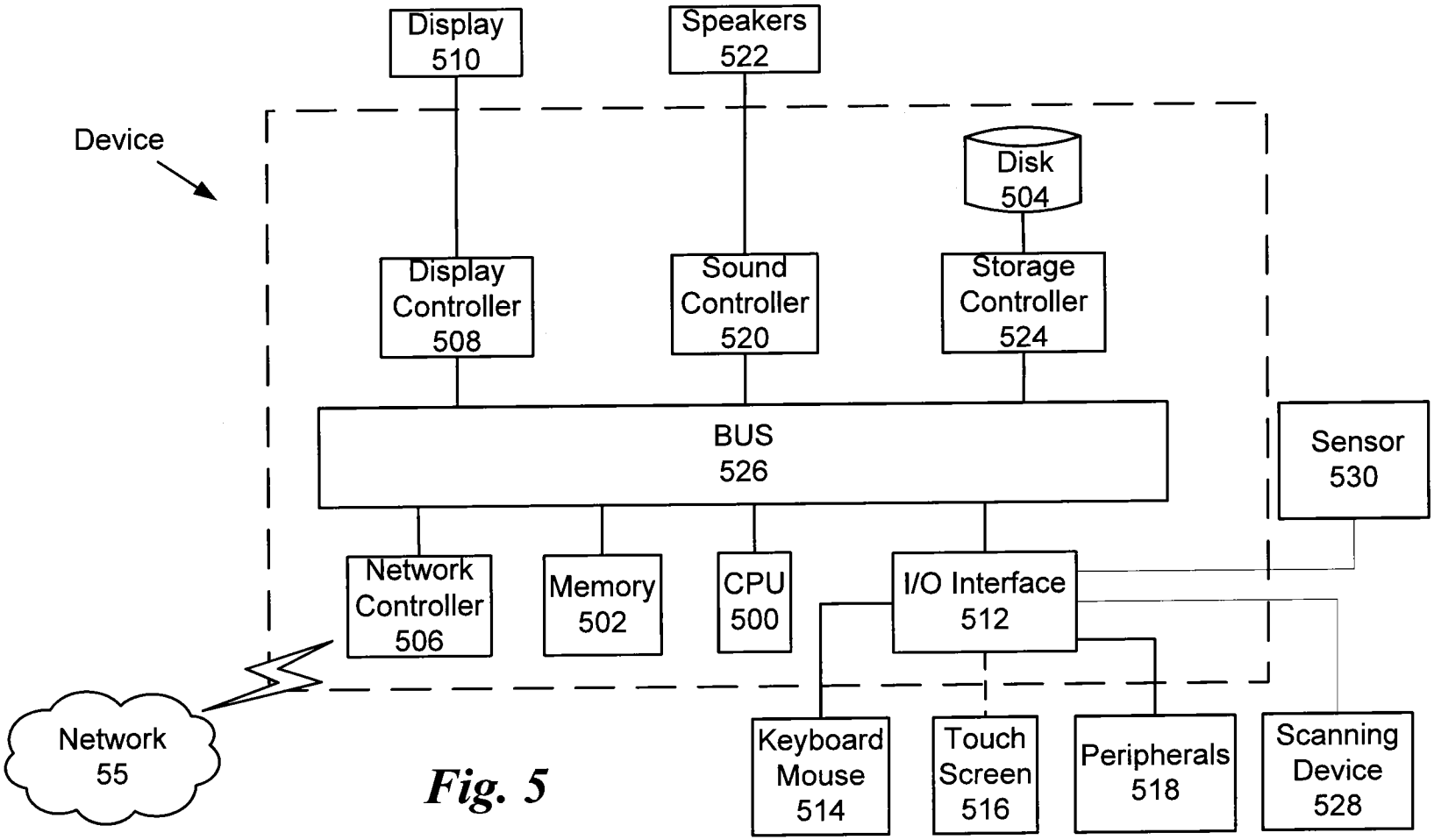
FIG. 5 is a block diagram of a processing unit, used in accordance with one or more embodiments.

Next, a hardware description of the processing unit according to exemplary embodiments is described with reference to FIG. 5. In FIG. 5, the processing unit includes a CPU 500 which performs the processes described above. The process data and instructions may be stored in memory 502. These processes and instructions may also be stored on a storage medium disk 504 such as a hard drive (HDD) or portable storage medium or may be stored remotely. Further, the claimed advancements are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the processing unit communicates, such as a server or computer.

Further, the claimed advancements may be provided as a utility application, background daemon, or component of an operating system, or combination thereof, executing in conjunction with CPU 500 and an operating system such as Microsoft Windows 7, UNIX, Solaris, LINUX, Apple MAC-OS and other systems known to those skilled in the art.

CPU 500 may be a Xenon or Core processor from Intel of America or an Opteron processor from AMD of America, or may be other processor types that would be recognized by one of ordinary skill in the art. Alternatively, the CPU 500 may be implemented on an FPGA, ASIC, PLD or using discrete logic circuits, as one of ordinary skill in the art would recognize. Further, CPU 500 may be implemented as multiple processors cooperatively working in parallel to perform the instructions of the inventive processes described above.

The processing unit in FIG. 5 also includes a network controller 506, such as an Intel Ethernet PRO network interface card from Intel Corporation of America, for interfacing with network 55. As can be appreciated, the network 55 can be a public network, such as the Internet, or a private network such as an LAN or WAN network, or any combination thereof and can also include PSTN or ISDN sub-networks. The network 55 can also be wired, such as an Ethernet network, or can be wireless such as a cellular network including EDGE, 3G and 4G wireless cellular systems. The wireless network can also be WiFi, Bluetooth, or any other wireless form of communication that is known.

The processing unit further includes a display controller 508, such as a NVIDIA GeForce GTX or Quadro graphics adaptor from NVIDIA Corporation of America for interfacing with display 510, such as a Hewlett Packard HPL2445w LCD monitor. A general purpose I/O interface 512 interfaces with a keyboard and/or mouse 514 as well as a touch screen panel 516 on or separate from display 510. General purpose I/O interface 512 also connects to a variety of peripherals 518 including printers and scanners, such as an OfficeJet or DeskJet from Hewlett Packard.

A sound controller 520 is also provided in the processing unit, such as Sound Blaster X-Fi Titanium from Creative, to interface with speakers/microphone 522 thereby providing sounds and/or music.

The general purpose storage controller 524 connects the storage medium disk 504 with communication bus 526, which may be an ISA, EISA, VESA, PCI, or similar, for interconnecting all of the components of the processing unit. A description of the general features and functionality of the display 510, keyboard and/or mouse 514, as well as the display controller 508, storage controller 524, network controller 506, sound controller 520, and general purpose I/O interface 512 is omitted herein for brevity as these features are known.

Numerous modifications and variations of the present invention are possible in light of the above teachings. It is therefore to be understood that within the scope of the appended claims, the invention may be practiced otherwise than as specifically described herein.

The invention claimed is:

1. An automatic ironing system, comprising:

a volumetric enclosure configured to receive an article to be steamed;

a base configured to support, power, and provide steamed water to the volumetric enclosure;

a rotary engine configured to rotate the article when activated;

at least one steam nozzle configured to direct steam towards the article;

a receptacle configured to receive condensed steam from the volumetric enclosure and to recirculate the condensed steam for re-use;

a controller configured to monitor one or more variables of the automatic ironing system and adjust parameters according to instructions; and a scanning device configured to identify the article.

2. The automatic ironing system of claim 1, wherein the volumetric enclosure includes an anti-heat material.

3. The automatic ironing system of claim 1, wherein the rotary engine is adjustable to alternate between clockwise and counter clockwise rotations.

4. The automatic ironing system of claim 1, wherein the at least one steam nozzle includes multiple pliable steam nozzles of varying vertical lengths.

5. The automatic ironing system of claim 1, wherein the at least one steam nozzle includes a flexible material.

6. The automatic ironing system of claim 1, further comprising:

a purge system configured to remove deposits from the at least one steam nozzle and the receptacle.

7. The automatic ironing system of claim 1, further comprising:

a water filter attachment configured to filter incoming water prior to circulation within the volumetric enclosure.

8. The automatic ironing system of claim 1, further comprising:

one or more hanger attachments configured to attach to the rotary engine and to suspend the article to be steamed.

9. The automatic ironing system of claim 1, further comprising:

one or more flexible weight extensions extending from the base and configured to attach to an edge of the article.

10. The automatic ironing system of claim 1, further comprising:

a fabric sensor configured to identify a fabric of the article.

11. The automatic ironing system of claim 1, wherein the volumetric enclosure is expandable and collapsible in a vertical and horizontal direction.

12. An automated method of ironing an article, comprising:

dispensing steam within a volumetric enclosure, via one or more flexible steam nozzles;

rotating an article suspended from a rotary engine of the volumetric enclosure;

capturing condensed steam in a reservoir for recirculation within the volumetric enclosure;

controlling one or more parameters according to instructions, via a controller connected to the volumetric enclosure; and identifying the article via a scanning device.

13. The method of claim 12, further comprising:

expanding and collapsing the volumetric enclosure in a vertical and horizontal direction.

14. The method of claim 12, further comprising:

adjusting one of an amount and a rate of the dispensing.

15. The method of claim 12, further comprising:

purging the one or more flexible steam nozzles and the reservoir to remove deposits.

16. The method of claim 12, further comprising:

issuing an alert signal when a level of water in the reservoir is below a set amount.

17. The method of claim 12, further comprising:

identifying a fabric of the article via a fabric sensor.

18. The method of claim 12, further comprising:

supporting, powering, and providing the volumetric enclosure with steam via a powered base connected to the volumetric enclosure.

* * * * *